US007624727B2

(12) United States Patent
Campo

(10) Patent No.: US 7,624,727 B2
(45) Date of Patent: Dec. 1, 2009

(54) ELECTRONIC PAINTBALL MARKER

(75) Inventor: John E. Campo, Medford, NJ (US)

(73) Assignee: Kee Action Sports I LLC, Sewell, NJ (US)

( * ) Notice: Subject to any disclaimer, the term of this patent is extended or adjusted under 35 U.S.C. 154(b) by 0 days.

(21) Appl. No.: 11/651,929

(22) Filed: Jan. 10, 2007

(65) Prior Publication Data

US 2007/0215135 A1 Sep. 20, 2007

Related U.S. Application Data

(63) Continuation of application No. 10/571,727, filed as application No. PCT/US2004/030350 on Sep. 16, 2004.

(60) Provisional application No. 60/503,178, filed on Sep. 16, 2003.

(51) Int. Cl.
*F41B 11/00* (2006.01)

(52) U.S. Cl. ..... 124/77; 124/32; 42/69.02

(58) Field of Classification Search ..... 124/71–77, 124/32; 42/69.02

See application file for complete search history.

(56) References Cited

U.S. PATENT DOCUMENTS

| | | | | | |
|---|---|---|---|---|---|
| 1,167,178 | A | | 4/1916 | Hill | |
| 1,958,254 | A | | 12/1934 | Huse | |
| 1,985,254 | A | | 12/1934 | Huse | |
| 2,214,297 | A | | 9/1940 | Ferry | |
| 2,424,247 | A | * | 7/1947 | McCaslin | 42/69.02 |
| 2,568,432 | A | | 9/1951 | Cook | |
| 2,869,563 | A | * | 1/1959 | Schoengrun | 137/43 |
| 2,957,391 | A | * | 10/1960 | Lovercheck | 89/28.05 |
| 3,086,469 | A | * | 4/1963 | Musgrave | 102/210 |
| 3,250,034 | A | * | 5/1966 | Simmons | 42/84 |
| 3,273,553 | A | | 9/1966 | Doyle | |
| 3,463,136 | A | | 8/1969 | Vadas et al. | |
| 3,762,087 | A | * | 10/1973 | Strubin | 42/84 |
| 3,899,845 | A | | 8/1975 | Wild et al. | |
| 4,009,536 | A | | 3/1977 | Wolff | |
| 4,369,759 | A | | 1/1983 | Gerstenberger et al. | |
| 4,446,599 | A | | 5/1984 | Karubian et al. | |
| 4,757,629 | A | * | 7/1988 | Austin | 42/84 |
| 5,349,938 | A | * | 9/1994 | Farrell | 124/73 |
| 5,727,538 | A | * | 3/1998 | Ellis | 124/77 |
| 5,791,325 | A | * | 8/1998 | Anderson | 124/56 |
| 5,890,479 | A | * | 4/1999 | Morin | 124/31 |
| 5,967,133 | A | | 10/1999 | Gardner, Jr. | |
| 6,003,504 | A | | 12/1999 | Rice et al. | |
| 6,062,208 | A | * | 5/2000 | Seefeldt et al. | 124/71 |
| 6,142,137 | A | * | 11/2000 | MacLaughlin | 124/72 |

(Continued)

FOREIGN PATENT DOCUMENTS

DE 3631262 A1 3/1988

(Continued)

*Primary Examiner*—Troy Chambers
(74) *Attorney, Agent, or Firm*—Volpe and Koenig, P.C.

(57) ABSTRACT

The present invention is directed to an electronically controlled paintball marker with magnetic control, having a trigger in communication with an electronic controller and a bolt configured to reciprocate in response to a magnetic force applied to a portion of the bolt during a firing sequence. Actuation of the trigger initiates a firing sequence activating electromagnets controlled by the electronic controller.

22 Claims, 15 Drawing Sheets

U.S. PATENT DOCUMENTS

| | | | | |
|---|---|---|---|---|
| 6,439,217 | B1 * | 8/2002 | Shih | 124/77 |
| 6,568,381 | B2 | 5/2003 | Chang | |
| 6,601,780 | B1 * | 8/2003 | Sheng | 239/337 |
| 6,618,975 | B1 | 9/2003 | Shih | |
| 6,637,420 | B2 | 10/2003 | Moritz | |
| 6,668,478 | B2 * | 12/2003 | Bergstrom | 42/1.06 |
| 6,807,959 | B1 | 10/2004 | Murdock et al. | |
| 2002/0104524 | A1 * | 8/2002 | Reible | 124/73 |
| 2002/0178901 | A1 | 12/2002 | Bergstrom | |
| 2003/0000511 | A1 | 1/2003 | Moritz | |
| 2003/0010330 | A1 | 1/2003 | Jong | |
| 2003/0066520 | A1 | 4/2003 | Chang | |
| 2003/0221684 | A1 * | 12/2003 | Rice | 124/71 |
| 2005/0178373 | A1 * | 8/2005 | Hatcher | 124/31 |
| 2006/0005825 | A1 | 1/2006 | Monks | |

FOREIGN PATENT DOCUMENTS

| | | | |
|---|---|---|---|
| GB | 2 313 655 | | 12/1997 |
| WO | 8805895 | A1 | 8/1988 |
| WO | 03/006913 | A2 | 1/2003 |

* cited by examiner

ELECTRONIC PAINTBALL MARKER

CROSS REFERENCE TO RELATED APPLICATIONS

This application is a continuation of U.S. patent application Ser. No. 10/571,727, filed Mar. 14, 2006, a § 371 National Phase filing of International Patent Application No. PCT/US04/030350, filed Sep. 16, 2004 which claims the benefit of U.S. Provisional Application No. 60/503,178, filed Sep. 16, 2003, which are incorporated by reference as if fully set forth.

FIELD OF INVENTION

The present invention is directed to an electronically controlled paintball marker. In particular, it relates to a magnetic paintball firing control system.

BACKGROUND

In recent years, the popularity of the combat game known as "Paintball" has increased dramatically. In one form of this game, players on two teams are each supplied with a paintball marker and a number of paintballs, that is, rounds of ammunition. The paintballs usually comprise a spherical gelatin or similar shell filled with a non-toxic, water-soluble, biodegradable paint. Paintball markers fire these paintballs using compressed gas as a propellant. These gas-propelled balls strike players and rupture, and in so doing, "paint" the target player and provide dramatic evidence of the hit, without substantially injuring the player.

A typical firing cycle of a paintball marker begins by a user manually cocking a bolt in the breech of the marker rearwardly, creating an opening through which a paintball from a loader in communication with the marker is able to fall, under the force of gravity, into the breech. Once the paintball is in the breech, the bolt slides forward to contact the paintball. When the trigger is pulled, a valve is momentarily opened releasing compressed gas through the bolt into the breech, forcing the paintball out of the barrel of the marker.

Semi-automatic paintball markers operate typically operate using a "blow-back" method wherein a first source of compressed gas discharges the paintball and a second source of compressed gas operates to return the firing mechanism to a ready -to-fire position. Such devices, however, require considerable compressed gas to fire and recoil the mechanism of the gun. An example of such a marker is shown in U.S. Publication No. 2004/0144377 to Dobbins, herein incorporated by reference, and shows a bolt that reciprocates using the compressed gas. Furthermore, such complex firing devices are often difficult to operate and maintain and often suffer breakdowns after extended periods of use. Paintball markers have also been developed that are automatic, i.e. fire repeatedly when the trigger is held back without manual recocking. The advent of automatic paintball markers has resulted in an increase in "ball chop." Ball chop occurs when the bolt moves forward towards the paintball while the paintball is only partially within the breech. The result is the ball is cut or smashed within the breech of the marker, fouling the paintball marker often entirely disabling it, effectively ending a player's game.

SUMMARY

It is therefore an object of the present invention to provide an electronic paintball marker comprising a breech having an inlet for receiving a paintball; first and second electromagnets disposed within the breech at a distance from each other; a sensor disposed within the breech for detecting the presence of a paintball; a processor in communication with the electromagnets and sensor; and a bolt moveable between the first and second electromagnets, wherein the bolt comprises an elongate body having first and second ends, each of said ends having a magnetic portion and wherein at least one of the electromagnets is actuated by the processor when the sensor detects a paintball, the actuation creating an attraction or a repulsion between the magnetic portion and the at least one electromagnet.

It is also an object of the present invention to provide an electronic paintball marker comprising a breech having first and second ends and an inlet for receiving a paintball; an electromagnet disposed within one of the ends; a sensor for detecting a paintball disposed within the breech; a processor in communication with the electromagnet and the sensor; and a bolt moveable between the sensor and the electromagnet, wherein the bolt comprises an elongate body having first and second ends, at least one of said ends having a magnetic portion and wherein the electromagnet is actuated by the processor when the sensor detects a paintball, the actuation selectively creating an attraction or a repulsion between the magnetic portion and the electromagnet.

It is a further object of the invention to provide a bolt for a paintball marker comprising an elongate body having first and second ends, each end having a magnetic portion, wherein the bolt moves back and forth within a breech of a paintball marker by magnetic forces exerted on the magnetic portions of the bolt.

It is a further object of the present invention to provide for a paintball marker wherein the bolt moves by magnetic attraction or repulsion.

BRIEF DESCRIPTION OF THE DRAWING(S)

DETAILED DESCRIPTION OF THE PREFERRED EMBODIMENT(S)

A paintball marker is usually a futuristic "gun-shaped" device having one or two grips for firing, a barrel from which a paintball is discharged, and a trigger for activating the marker to fire the paintball. The actual body and shape of the marker is not shown in the Figures because the invention discussed herein relates to only several components of a marker, and not the body of the marker itself. It should be understood that the invention herein could be adapted for use in almost any paintball marker body. In addition, it should be understood that the various components described herein may be mounted in or on the paintball marker.

Figure 1A:
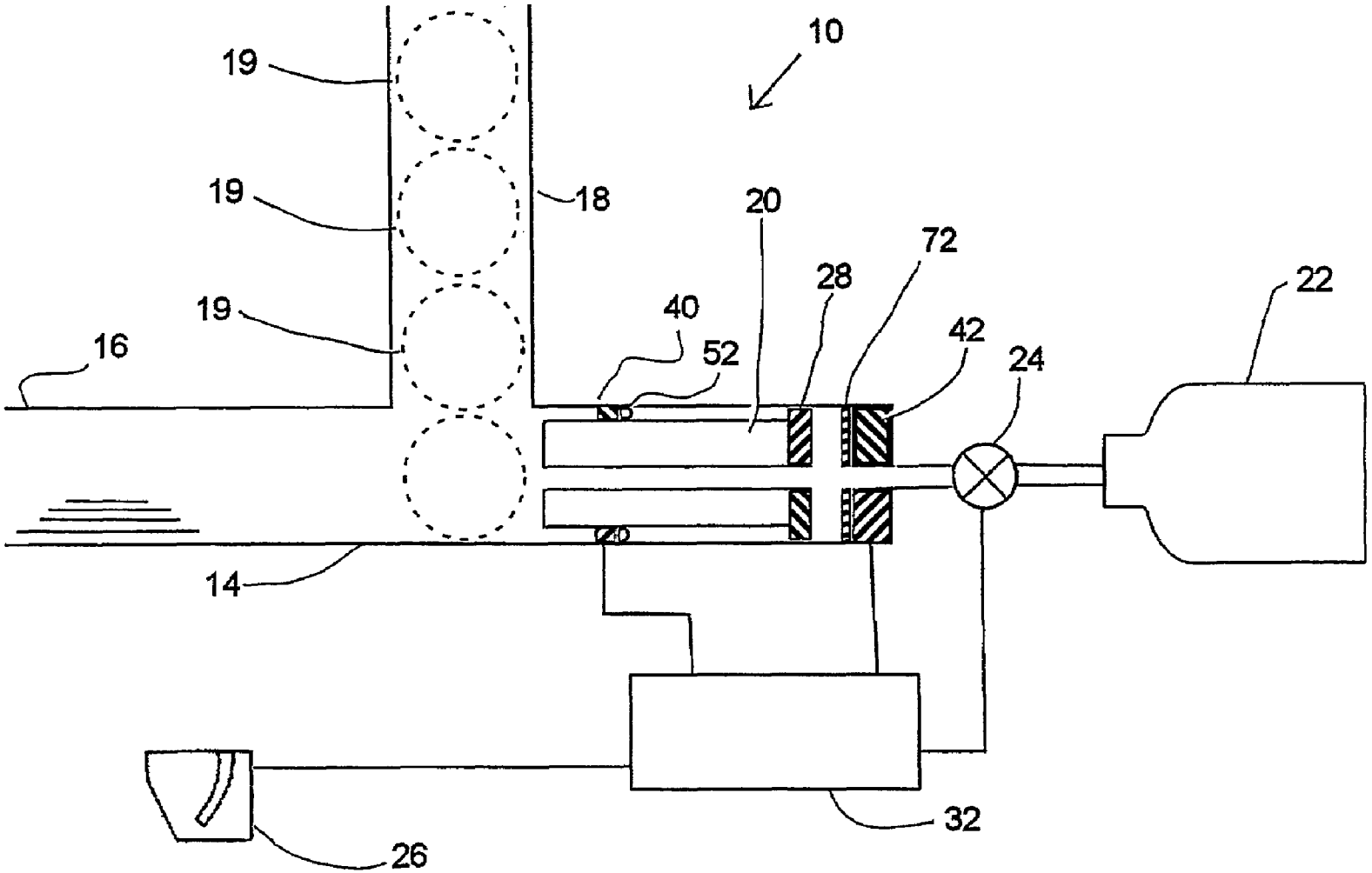
FIGS. 1A and 1B are schematic illustrations of a first embodiment of the paintball marker of the present invention.
Figure 1B:
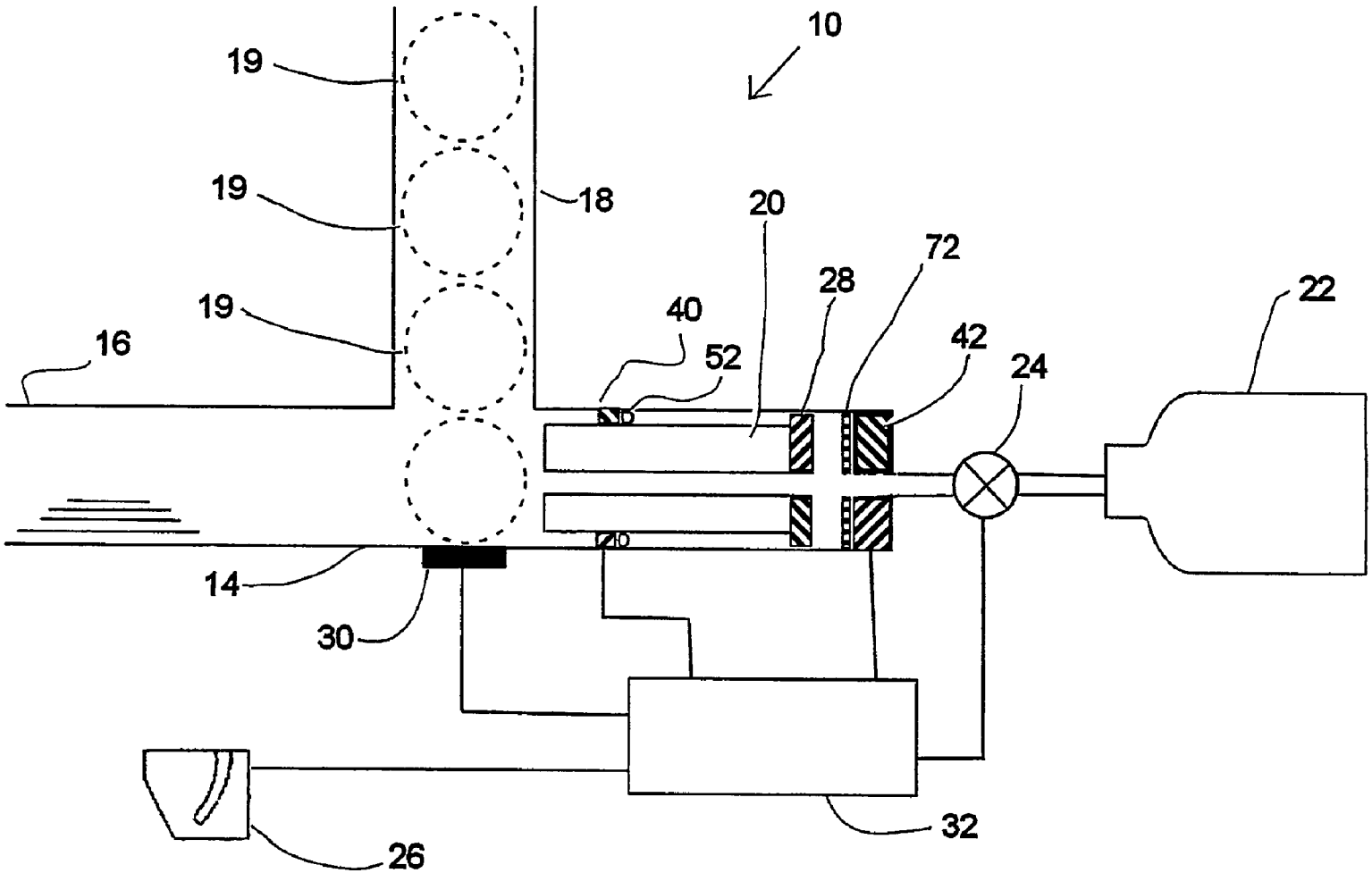

FIGS. 1A and 1B show an electronic paintball marker 10 comprising at least one electronic controller 32, typically a microprocessor, that can receive electronic signals from marker components and also control many marker functions. In the Figures, these electronic signals and control function relationships are shown by lines connecting components with the controller 32.

Referring to FIGS. 1A and 1B, a paintball marker 10 according to a first embodiment of the invention has a body, a breech 14 with a forward end and a rear end, a barrel 16 forward of the breech, a feed tube 18 for loading paintballs 19 into the breech, a reciprocating bolt 20 moveable between first and second positions, a source of compressed gas 22, an electronically actuated valve 24, and a trigger 26. These are common elements found on most paintball markers. In addition, all the embodiments can optionally have a ball sensor 30 positioned to detect the presence or absence of a ball in the breech 14. The ball sensor may be configured to provide a signal output to a microprocessor 32 when a paintball is detected in the breech 14, or when a paintball is absent in the breech.

The bolt 20 of the present invention has an elongate body with first and second ends and a through aperture. The bolt can also comprise at least one magnetic portion 28. The magnetic portion can be formed from a magnetized material that will be attracted to or repelled from a magnet. Any ferrous metal or other material that can be magnetized is acceptable. The magnetic portion 28 may also have a core formed from lightweight plastic and have an outer coating of a ferrous metallic material. Alternately, only the front and rear walls of the magnetized portion 28 need have an outer coating of a ferrous metallic material.

In a "closed bolt" arrangement, as is known in the art of paintball sports, the firing sequence includes trigger pull, signal to move bolt from a firing position to a loading position, loading of paintball, moving bolt from a loading position to firing position, opening valve to allow compressed gas to travel through the aperture in the bolt. Exemplary paintball marker arrangements are shown in U.S. Pat. Nos. 6,474,326 and 6,637,421, the entirety of which are incorporated by reference herein.

A closed-bolt arrangement of the present invention is depicted in FIG. 1A. The "home" or starting position of bolt 20 is a forward position preventing paintballs 19 from exiting feed tube 18 into the breech 14. When trigger 26 is actuated (pulled) by a user, a signal is provided to controller 32 indicating that a firing sequence should be initiated. The controller 32 then actuates first and second electromagnets 40, 42 either simultaneously, intermittently or sequentially. The magnets are spaced apart from one another, one in a forward position and the other in a rearward position. The activation of the rearward electromagnet 42 creates an attractive force on magnetic portion 28 of the bolt 20, causing the bolt to move in a rearward direction. In the meantime, the forward electromagnet, 40 is actuated to create a repulsive force on the magnetic portion 28, this repulsive force facilitates the movement of the bolt towards the rearward electromagnet 42. When the bolt 20 has moved rearwardly sufficiently to allow a paintball 19 to enter the breech 14, the controller reverses the polarity of the electromagnets 40, 42 causing the bolt to be attracted by the forward magnet 40 and be repulsed by the rearward magnet, thus causing the bolt to move in a forward position. The return to the "closed" position closes the bolt, preventing additional paintballs from entering the breech as well as moves the paintball to a firing position. Once in the firing position, the controller 32 momentarily opens valve 24 to release a controlled amount of gas from gas source 22 to fire the paintball from the barrel 16. This timed firing sequence is pre-programmed and therefore the closed-bolt arrangement does not require the use of sensors to indicate to the controller that the sequence should be initiated.

In an open-bolt arrangement is depicted in FIG. 1B. A sensor 30 can be disposed within the breech 14. Generally, the sensors can be one of several types (mechanical, movement, shock, optical), however, optical sensors are preferred. Optical sensors may use infrared light to detect the ball, and may comprise an emitter and a detector that form a light beam, the sensor being activated when an paintball 19 crosses the light beam. The emitter and detector may be positioned as required to detect a paintball within the breech. Or an optical sensor may detect a paintball when light emitted from the sensor is reflected back on the sensor.

When a user pulls the trigger 26, indicating a firing sequence is being initiated, the controller 32 activates sensor 30 to determine if a paintball is in the breech. If it is determined that a paintball 19 is in the breech. The controller 32 will activate the electromagnets 40, 42 to attract and repulse the magnetic portion 28 of the bolt 20 to move the bolt 20 in a forward direction. As above, once in the firing position, the controller 32 opens valve 24 to release a controlled amount of gas from gas source 22 to fire the paintball from the barrel 16.

Alternately, the open-bolt configuration may not rely on a sensor. Thus a firing sequence is initiated when a user pulls the trigger 26. The controller 32 will activate the electromagnets 40, 42 to attract and repulse the magnetic portion 28 of the bolt 20 to move the bolt 20 in a forward direction. As above, once in the firing position, the controller 32 opens valve 24 to release a controlled amount of gas from gas source 22 to fire the paintball from the barrel 16.

The marker 10 of the present invention may also comprise bumpers 52, 72 which serve to protect the magnetic portion 28 from excessive wear from contact with the electromagnets 40, 42. The bumpers can be of an elastomeric material such as rubber and also serve to reduce noise and provide greater comfort to a user.

Figure 2A:
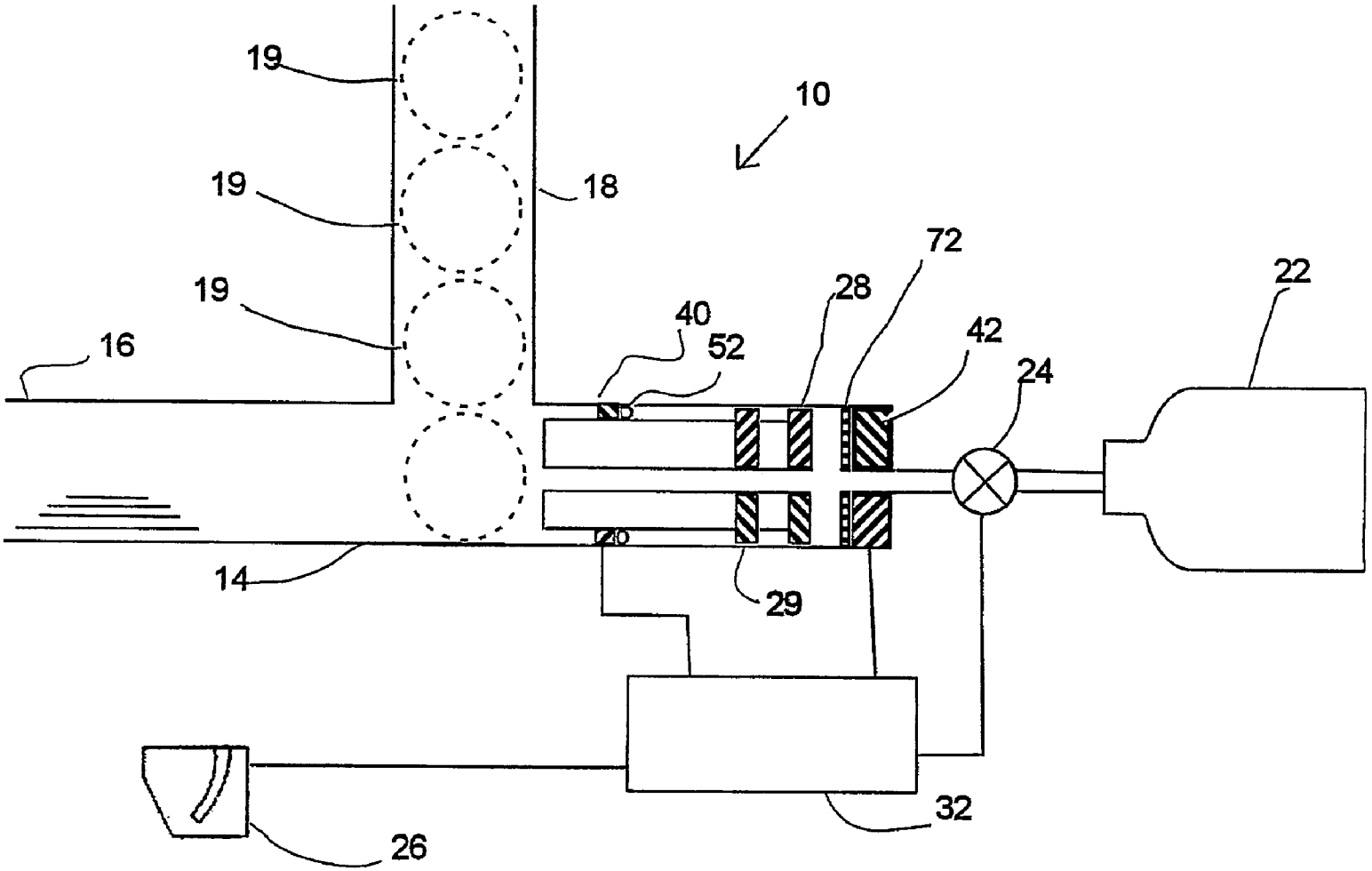
FIGS. 2A and 2B are schematic illustrations of a second embodiment of the paintball marker of the present invention.
Figure 2B:
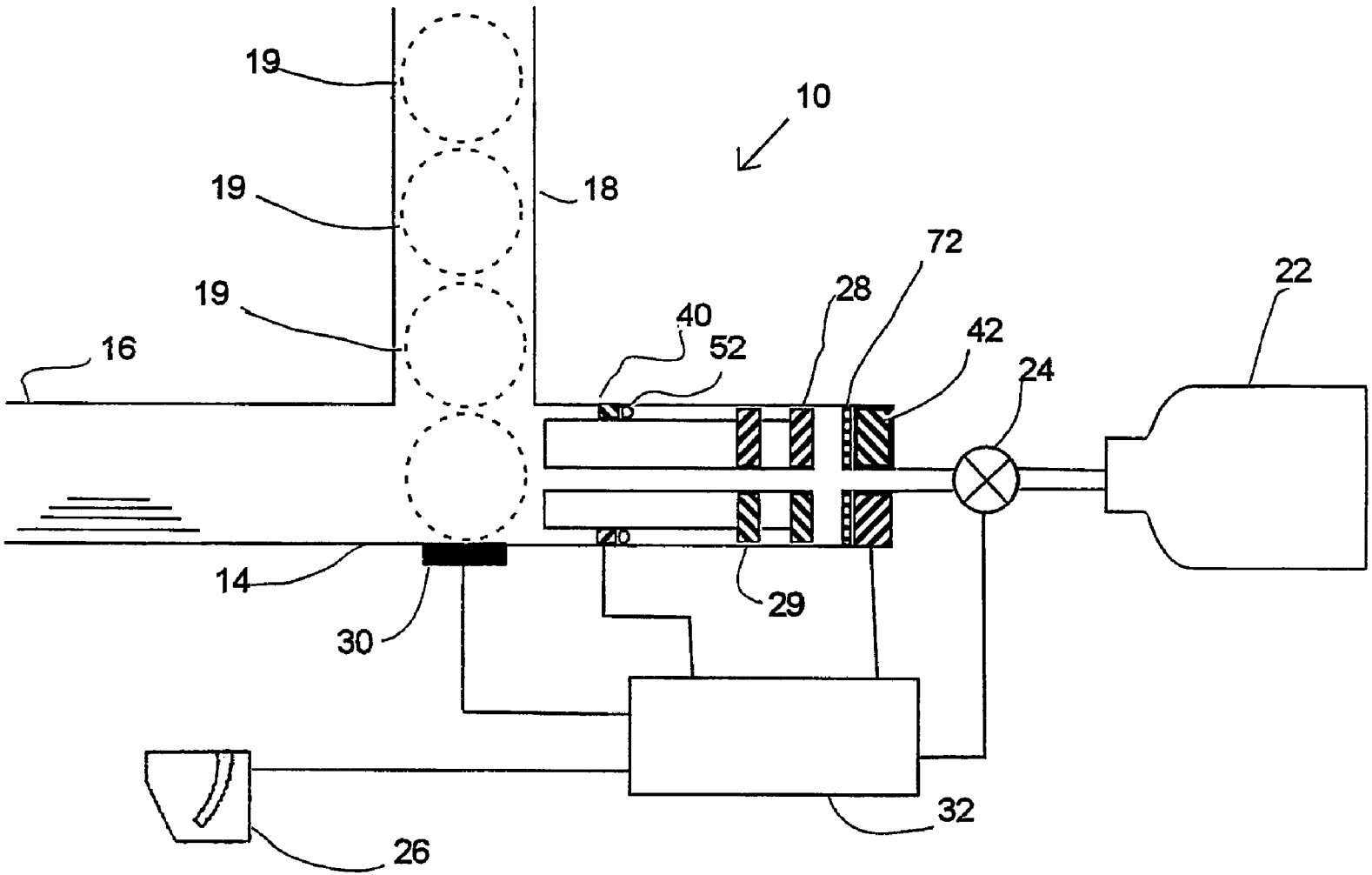

As shown in FIGS. 2A and 2B, the bolt 20 can also comprise a second magnetic portion 29. The addition of a second magnetic portion 29 provides greater attraction to the electromagnets 40, 42 and therefore reduces the power requirement for the electromagnets 40, 42.

Figure 3A:
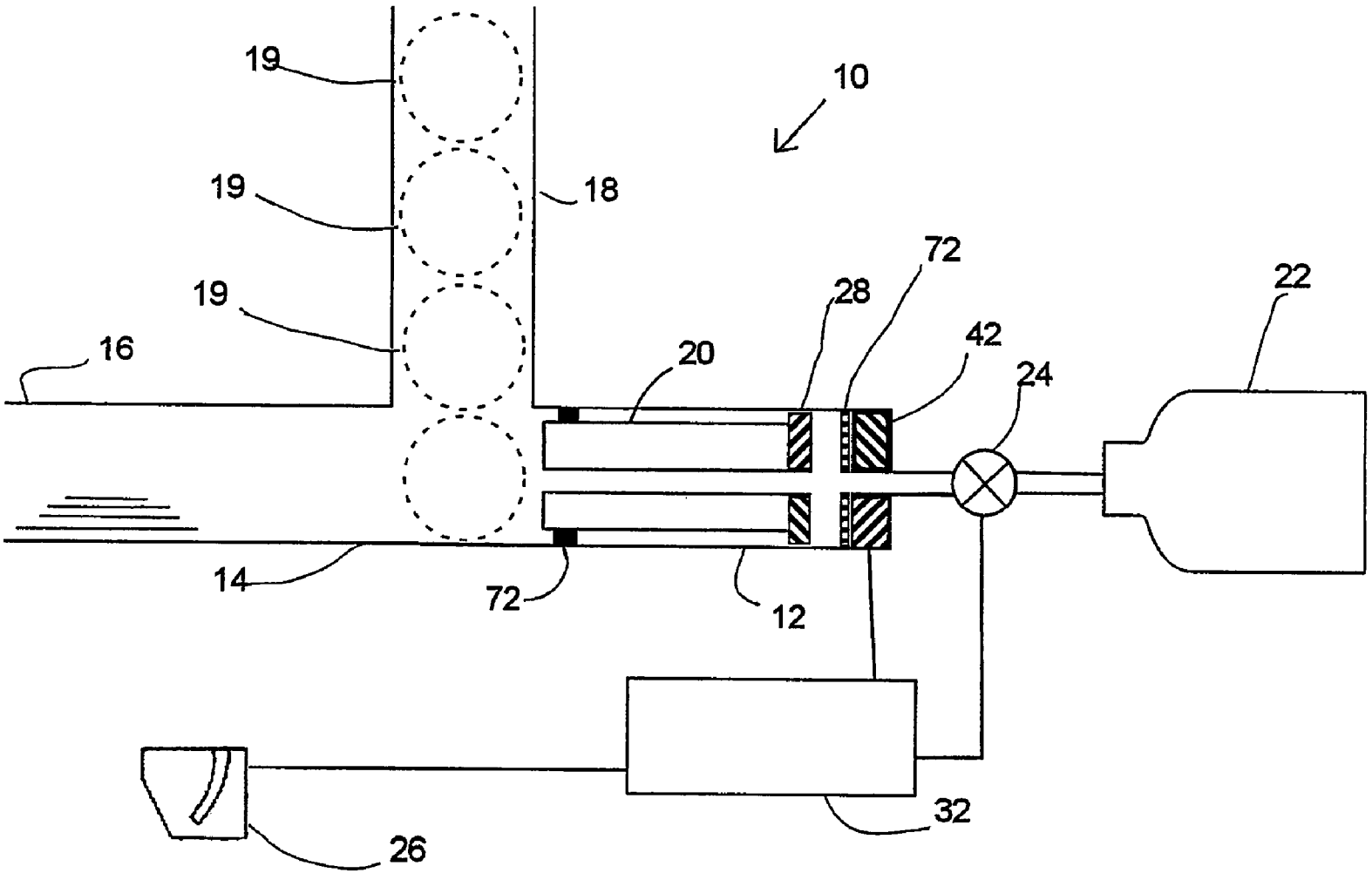
FIGS. 3A and 3B are schematic illustrations of a third embodiment of the paintball marker of the present invention.
Figure 3B:
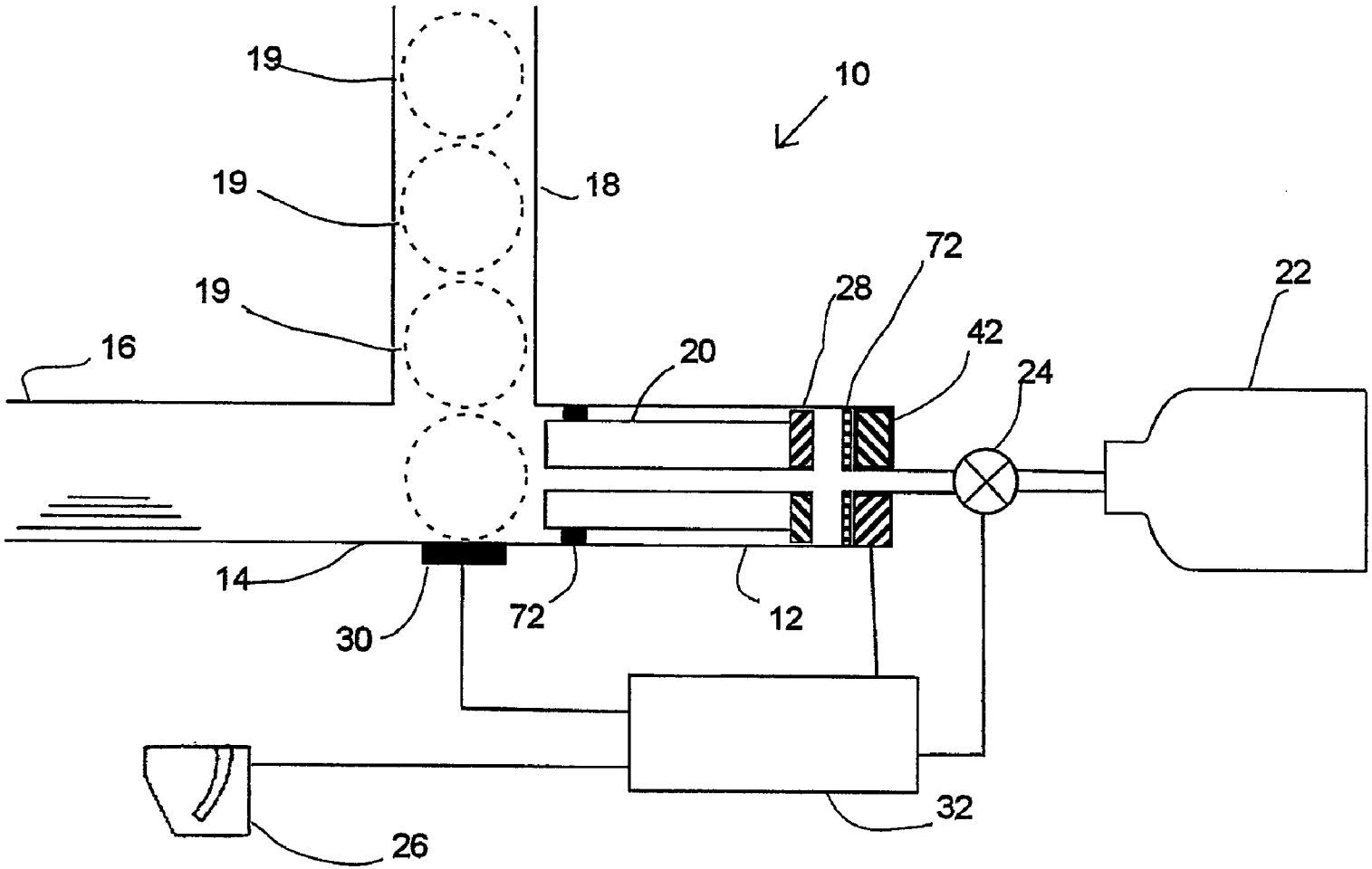

FIGS. 3A and 3B depict an embodiment having only one electromagnet 42. In this embodiment, the forward electromagnet has been replaced with a bumper 72 that also serves to stop the forward motion of the bolt 20 when it is moving forward. As in the previous embodiments, a user pulls trigger 26 to initiate a firing sequence. The controller 32 receives the signal from the trigger and actuates the electromagnet 42 to attract the bolt 20. Once the bolt 20 has moved rearward sufficiently to allow a paintball 19 to fall into the breech 14, the controller reverses the polarity so that the bolt is repelled from the electromagnet in a forward direction. The movement and valve control may be regulated by the controller using preset or user modifiable timing parameters (e.g. software included with the microprocessor of the controller).

Figure 4A:
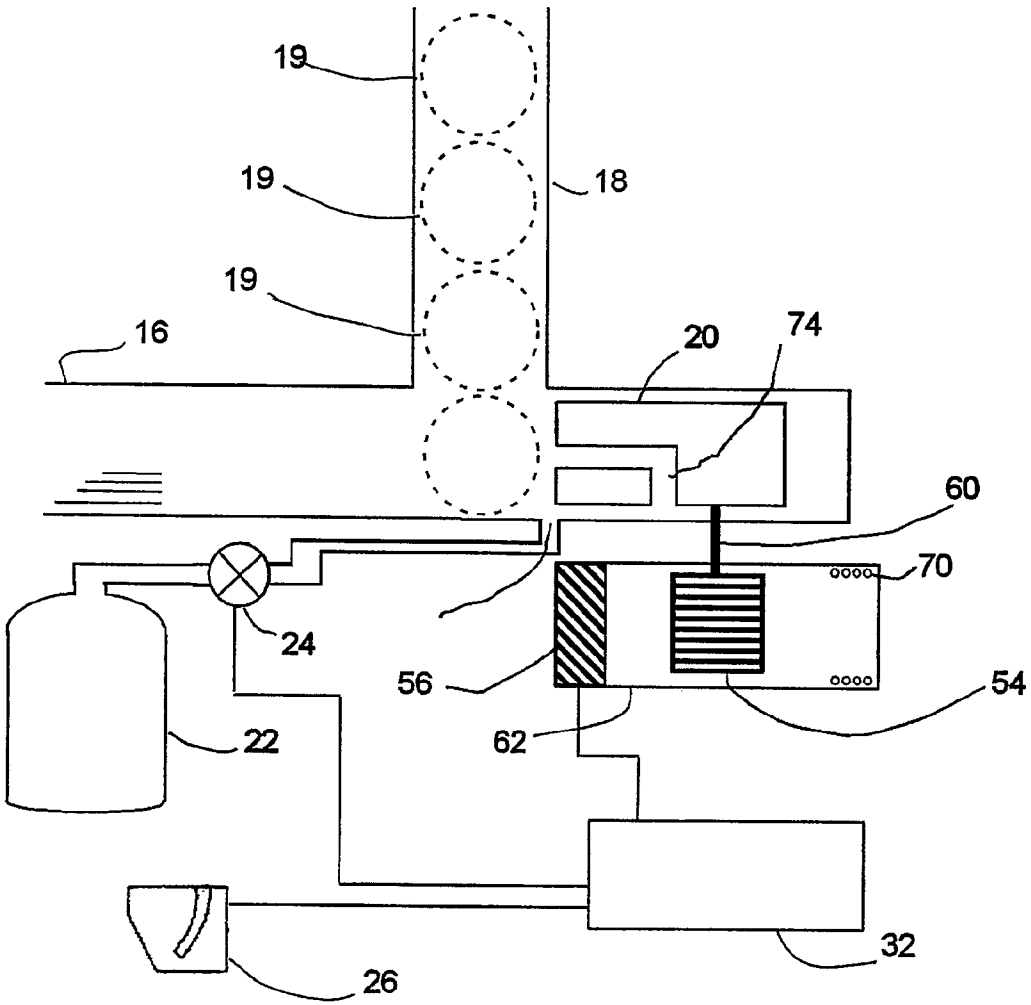
FIGS. 4A-4C are schematic illustrations of a fourth embodiment of the paintball marker of the present invention.
Figure 4B:
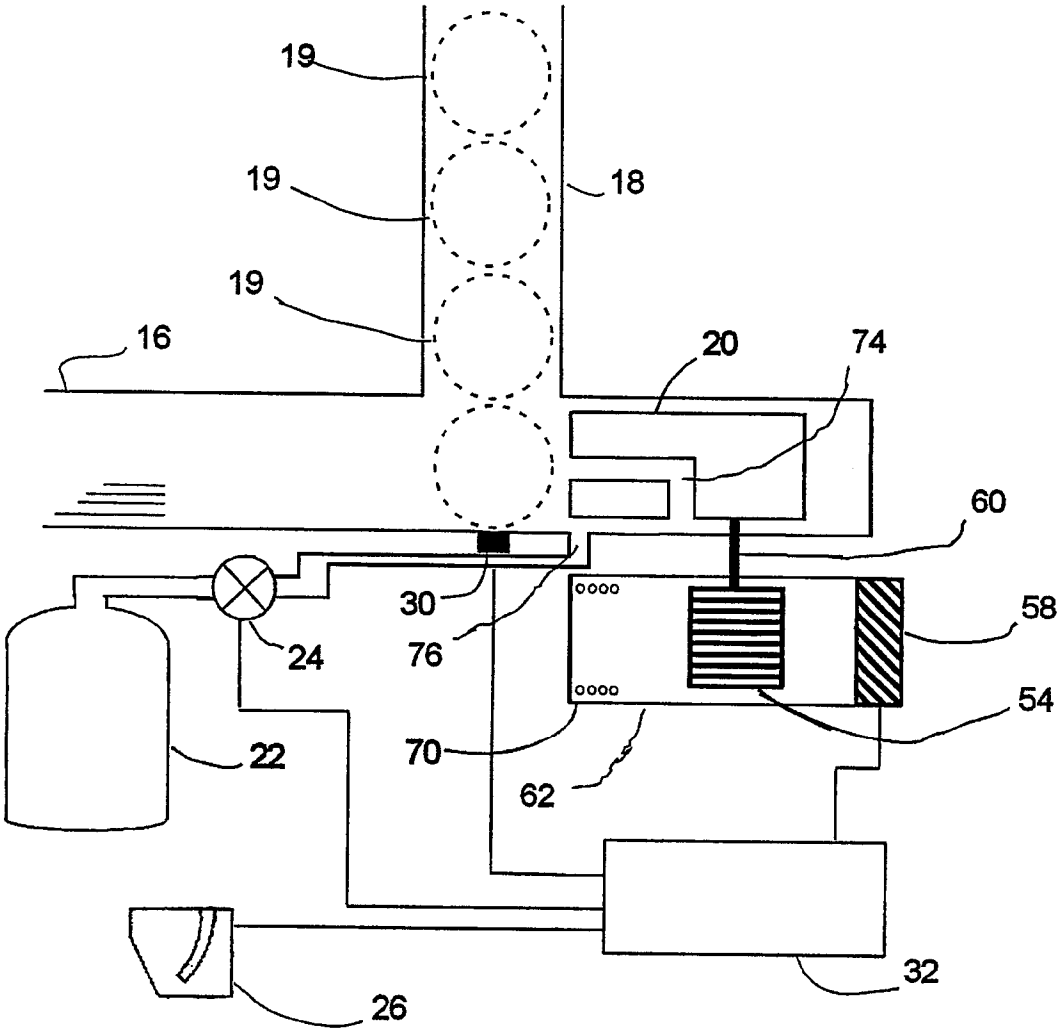
Figure 4C:
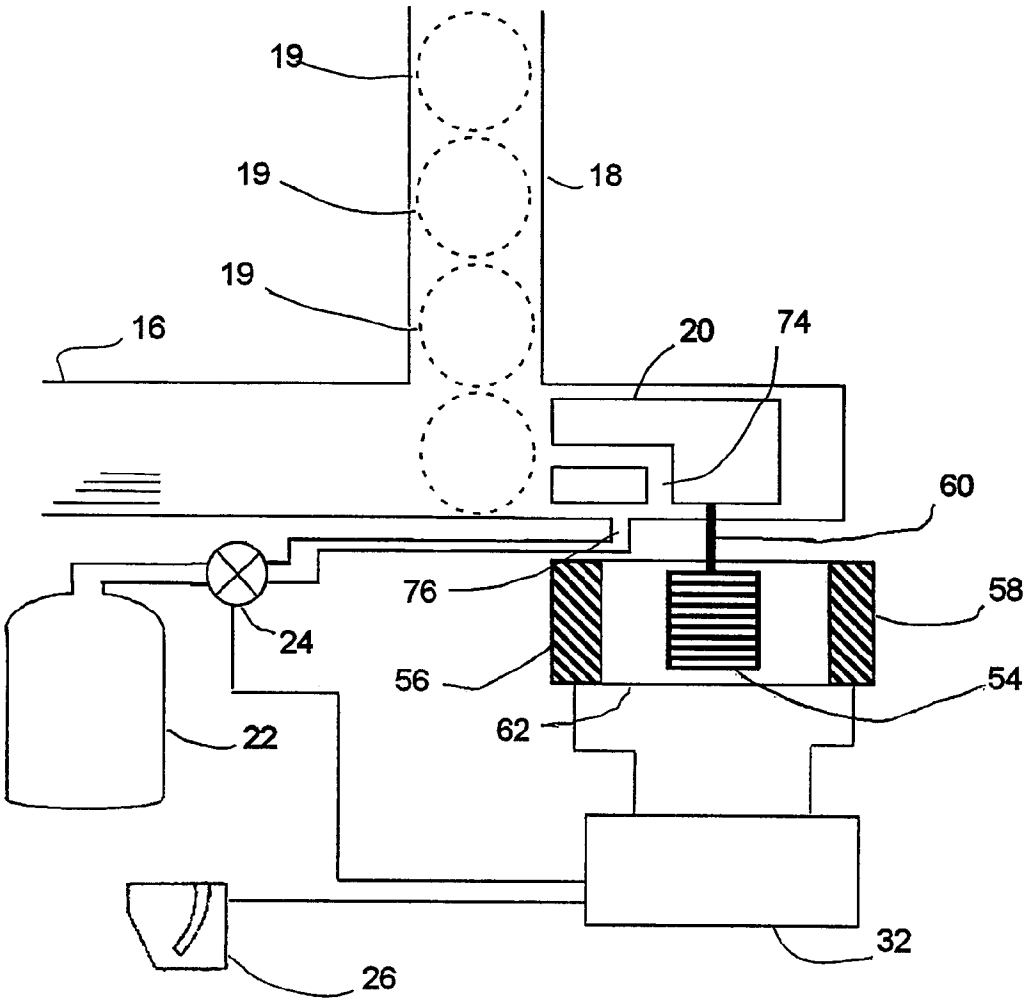

A fourth embodiment is depicted by FIGS. 4A-4C. In this embodiment, the paintball marker 10 has a bolt carrier cylinder 62 essentially parallel to the breech 14, and a bolt carrier piston 54 contained in the cylinder 62. The bolt 20 and bolt carrier piston 54 are linked via mechanical linkage 60 passing through a slot in the cylinder. Such assemblies, where a cylinder carrying a "ram," "hammer," or piston attached to a bolt of a paintball marker are well known in the art. The bolt carrier piston 54 is adapted to slide between a rear position and a forward position. The bolt carrier piston 54 is made of or coated with a magnetic material, or has a magnetic portion. The bolt carrier cylinder has a first electromagnet 56 at its forward end, and a second electromagnet 58 at its rear end (FIG. 4C). As described above, the controller 32 will selectively energize the electromagnets in a sequence that will first move the piston 54 rearward. Because the bolt 20 and piston 54 are mechanically coupled, the bolt 20 will be carried forward when the piston 54 moves forward. Selective activation of the magnets to reverse the magnetic field will move the bolt rearward. This embodiment operates essentially the same as the operation of the embodiment of FIG. 1A discussed above. As shown in FIGS. 4A and 4B, a single electromagnet may be used to move piston 54 back and forth. In this embodiment a spring 70 assists with the returning of the piston 54 to its home position. The spring can be a helical spring, a cup spring and elastomer, etc. The embodiment of FIGS. 4A-4C also provides a channel 74 in the bolt 20 and an inlet 76 for compressed gas to flow from source 22. It is appreciated that the channel 74 and inlet 76 can be arranged according to many variations within the body of a marker 10, so long as compressed gas is supplied to the breech as necessary to fire the paintball marker.

Figure 5A:
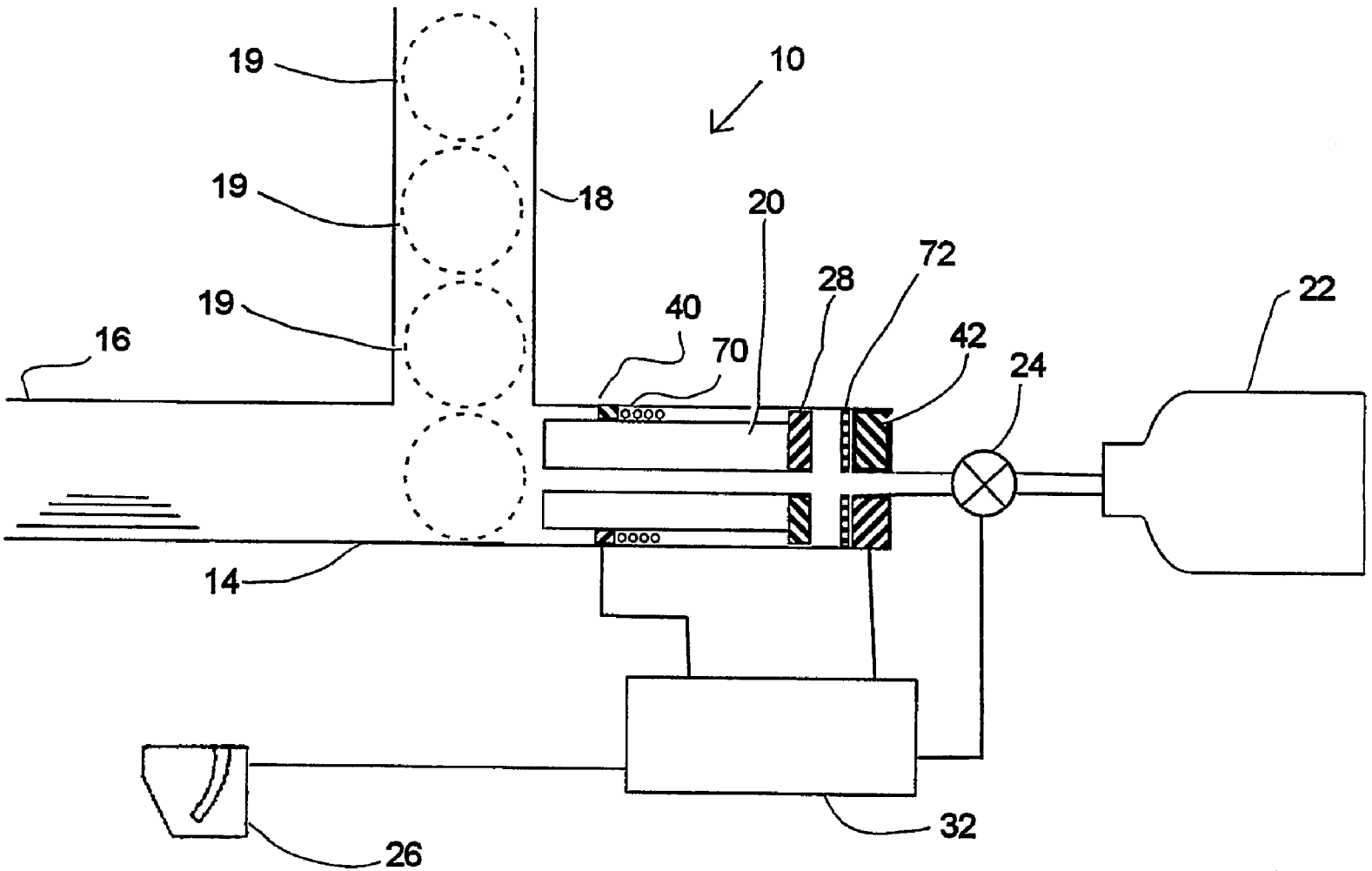
FIGS. 5A and 5B are schematic illustrations of a fifth embodiment of the paintball marker of the present invention.
Figure 5B:
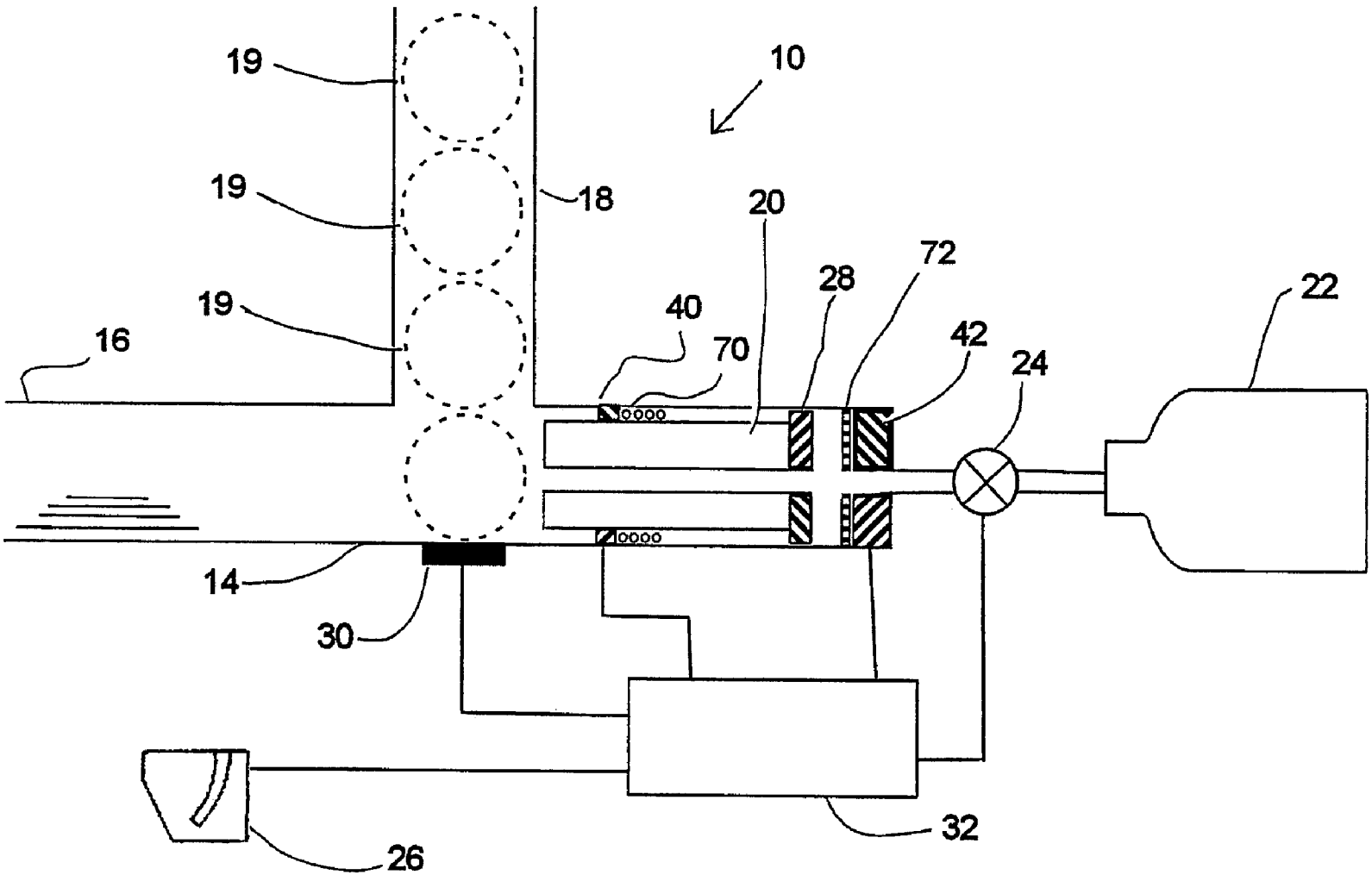
Figure 5C:
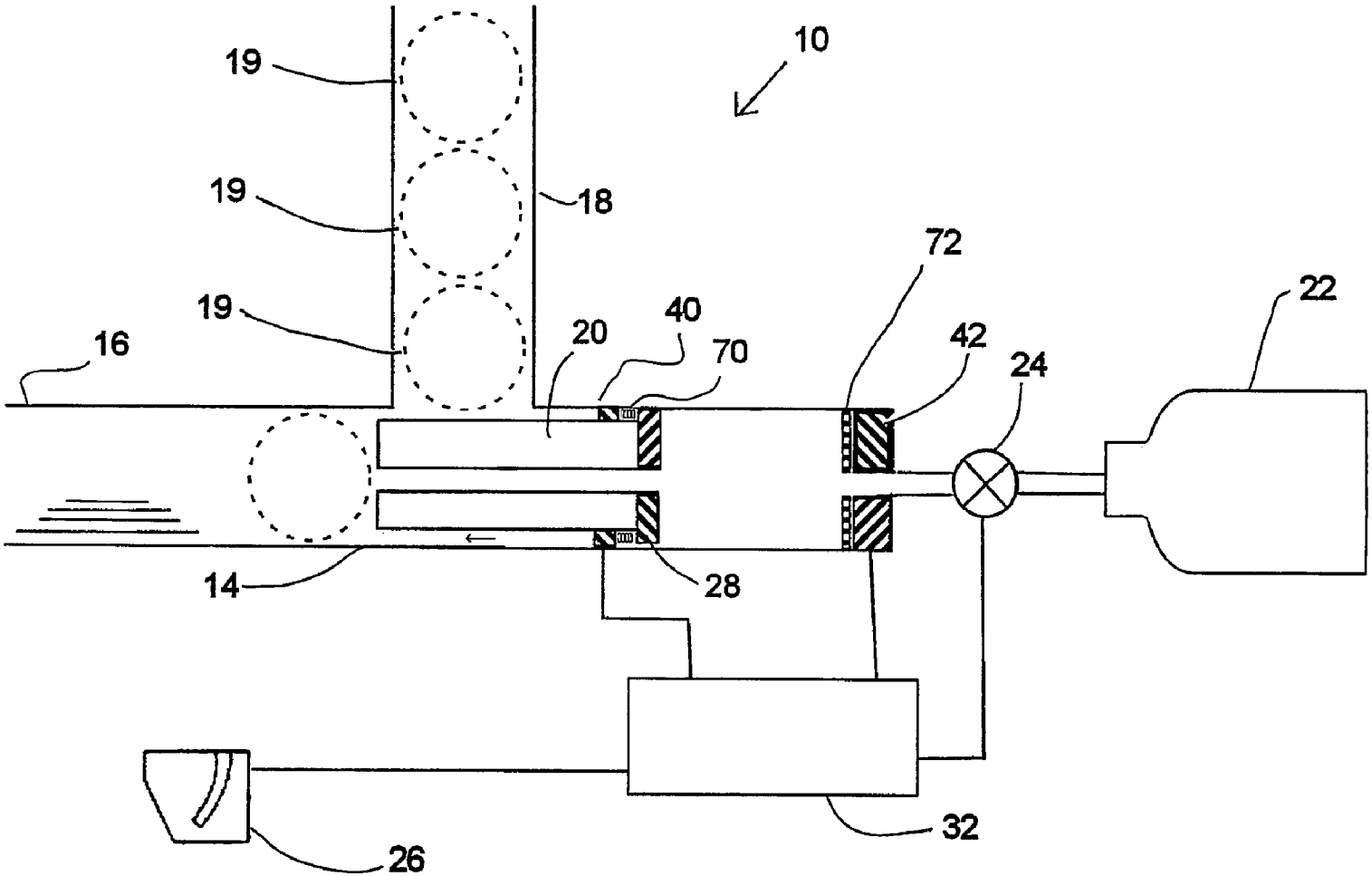
FIG. 5C is a schematic illustration of the embodiment shown in FIG. 5A with the bolt in the closed position.

FIGS. 5A-5C depict an arrangement having two electromagnets 40, 42 and a spring 70 to assist in the return of the bolt 20 to its home position. FIG. 5C shows the bolt 20 in a forward position closing feed tube 18 and moving the paintball 19 into firing position. When springs are used, power requirements of the electromagnets are reduced, thereby prolonging battery life.

Figure 6A:
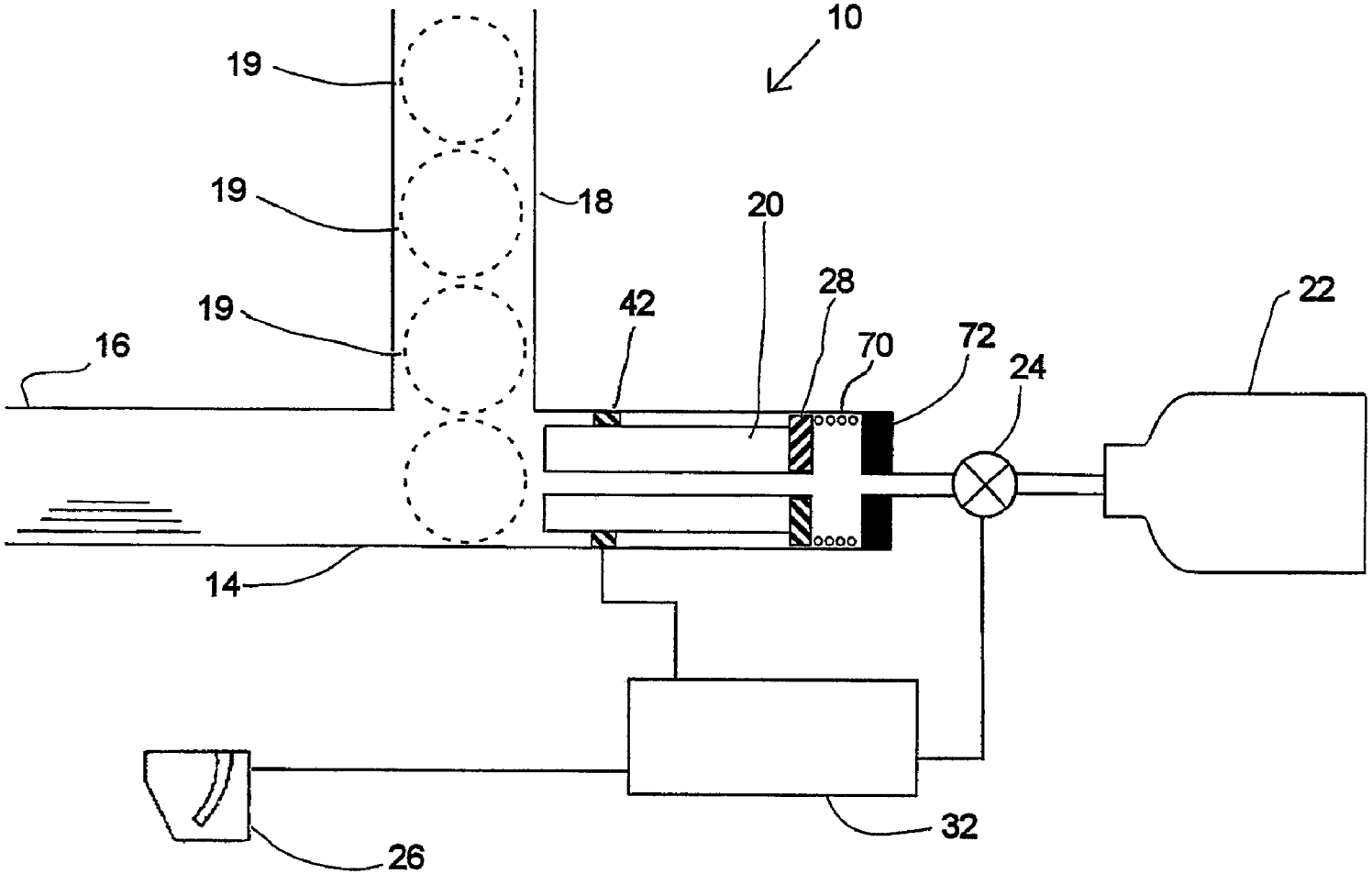
FIGS. 6A-6C are schematic illustrations of a sixth embodiment of the paintball marker of the present invention.
Figure 6B:
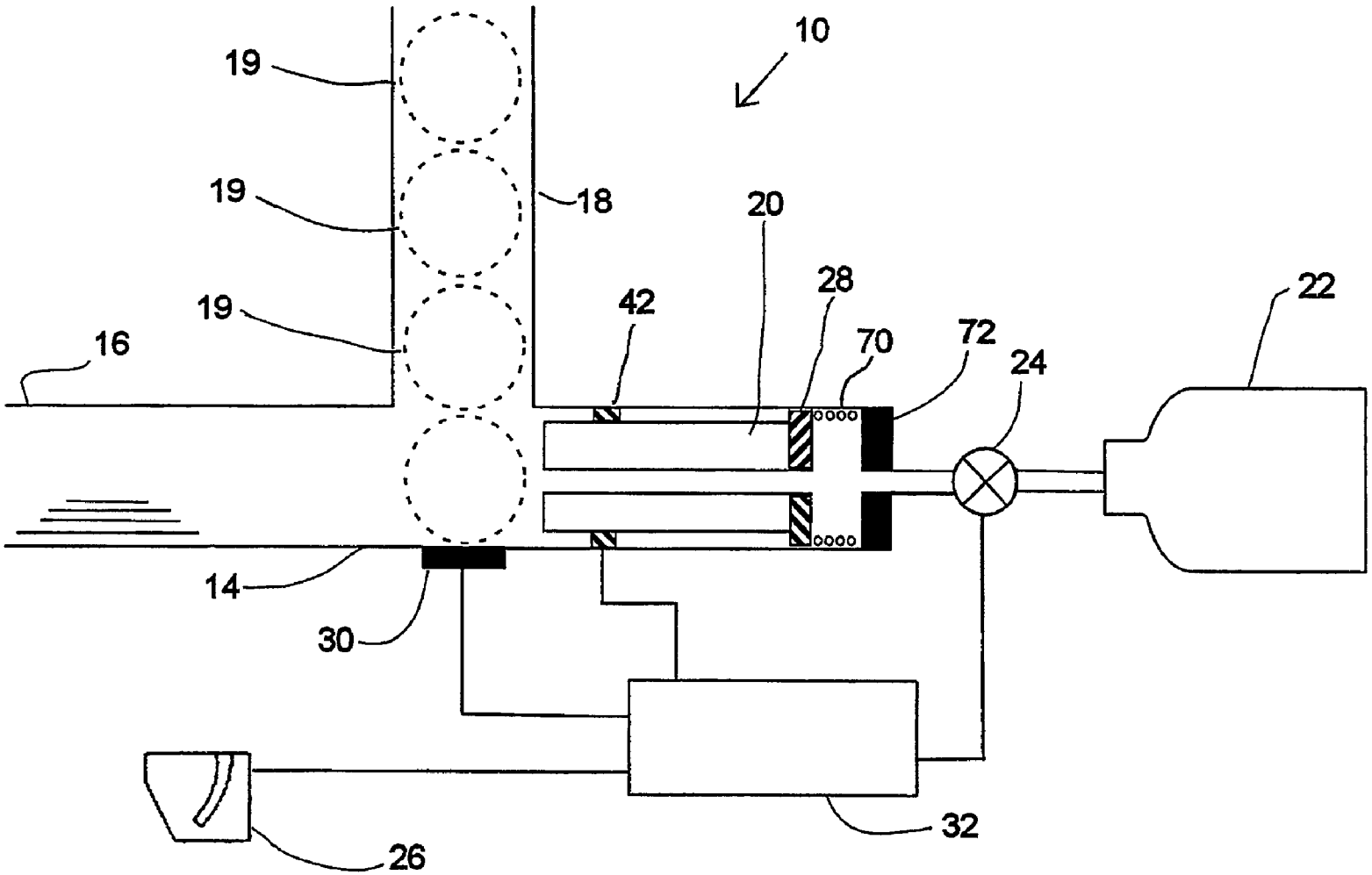
Figure 6C:
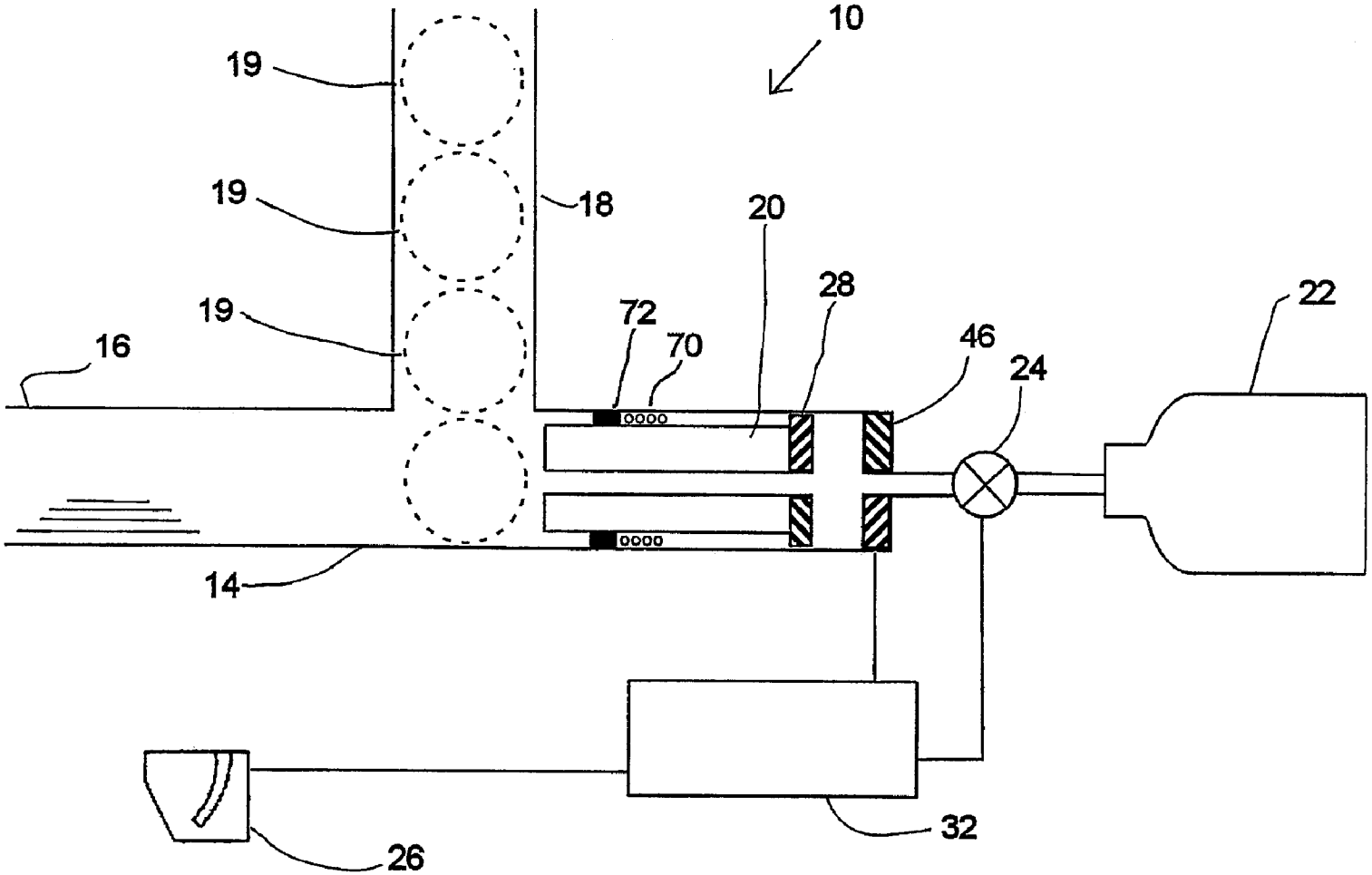

FIGS. 6A-6C show an arrangement having a single electromagnet either forward 42 or rearward 46 and a spring 70 to facilitate the return of the bolt 20 to its home position. Bumpers 72 act as stops to restrict the forward and rearward movement of the bolt 20.

The firing sequence may include different steps depending on the embodiment of the paintball marker of the present invention. In simple terms, the firing sequence for a "closed bolt" arrangement may be: (a) trigger actuation; (b) bolt moved rearward to load paintball; (c) bolt moved forward; and (d) valve opened to fire paintball. The firing sequence for an "open bolt" arrangement may be: (a) trigger actuation; (b) bolt moved forward; (c) valve opened to fire paintball; and, (d) bolt returned to "home" (or rearward) position. The movements are controlled by the controller, and the bolt is moved at least in part by magnetic force. Where a spring is used, the spring will bias the bolt or piston to one of either the rearward or forward positions, depending on the arrangement of the magnets and springs.

It should also be contemplated that the bolt can comprise an electromagnet rather than a magnetic portion.

What is claimed is:

1. An electro-magnetically operated bolt system, comprising:

a receiver body having a breech therein;

a moveable bolt received in the breech; and at least one electromagnet for selectively moving the bolt between a first position and a second position via magnetic force acting on the bolt.

2. The electro-magnetically operated bolt system of claim 1, further comprising: at least one magnetic portion disposed proximal to the at least one electromagnet; and a control device for selectively energizing the electromagnet wherein the electromagnet generates a magnetic field that exerts a force on the at least one magnetic portion thereby selectively moving the bolt between the first and second positions.

3. The electro-magnetically operated bolt system of claim 2, wherein the at least one electromagnet is disposed in the receiver body adjacent the breech and the at least one magnetic portion is disposed within the bolt.

4. The electro-magnetically operated bolt system of claim 2, wherein the at least one electromagnet is disposed in the bolt and the at least one magnetic portion is disposed within the receiver body adjacent the breech.

5. The electro-magnetically operated bolt system of claim 2, wherein the magnetic portion consists of a permanent magnet, the control device energizing the electromagnet with a first polarity wherein the force on the permanent magnet is an attractive force that moves the bolt to the first position and the control device energizing the electromagnet with a second polarity wherein the force on the permanent magnet is a repellant force that moves the bolt to the second position.

6. The electro-magnetically operated bolt system of claim 1, wherein the at least one electromagnet comprises a first electromagnet and a second electromagnet positioned in spaced relation to the first electromagnet; the system further comprising at least one magnetic portion disposed proximal to the first and second electromagnets; and a control device for selectively energizing the first and second electromagnets wherein the electromagnets generate independent magnetic fields that each exert a force on the at least one magnetic portion thereby selectively moving the bolt between the first and second positions.

7. The electro-magnetically operated bolt system of claim 6, wherein the first electromagnet is disposed in the receiver body adjacent a forward portion of the breech, the second electromagnet is disposed in the receiver body adjacent a rear portion of the breech and the at least one magnetic portion is disposed within the bolt.

8. The electro-magnetically operated bolt system of claim 7, wherein the magnetic portion consists of a permanent magnet; the control device energizing the first electromagnet with a first polarity, wherein the first electromagnet produces an attractive force on the permanent magnet and the control device energizing the second electromagnet with a second polarity, wherein the second electromagnet produces a repellant force on the permanent magnet, the attractive and repellant forces cooperating to move the bolt to the first position; and the control device energizing the first electromagnet with the second polarity, wherein the first electromagnet produces a repellant force on the permanent magnet and the control device energizing the second electromagnet with the first polarity, wherein the second electromagnet produces an attractive force on the permanent magnet, the attractive and repellant forces cooperating to move the bolt to the second position.

9. The electro-magnetically operated bolt system of claim 6, wherein the first electromagnet is disposed in a forward portion of the bolt, the second electromagnet is disposed in a rear portion of the bolt and the at least one magnetic portion is disposed within the receiver body adjacent the breech.

10. The electro-magnetically operated bolt system of claim 9, wherein the magnetic portion consists of a ferrous metal, the control device energizing the first electromagnet wherein the first electromagnetic exerts an attractive force on the ferrous metal that moves the bolt to the first position and the control device energizing the second electromagnet wherein the second electromagnet exerts an attractive force on the ferrous metal that moves the bolt to the second position.

11. The electro-magnetically operated bolt system of claim 9, wherein magnetic portion consists of a permanent magnet; the control device energizing the first electromagnet with a first polarity, wherein the first electromagnet produces an attractive force on the permanent magnet and the control device energizing the second electromagnet with a second polarity, wherein the second electromagnet produces a repellant force on the permanent magnet, the attractive and repellant forces cooperating to move the bolt to the first position; and the control device energizing the first electromagnet with the second polarity, wherein the first electromagnet produces a repellant force on the permanent magnet and the control device energizing the second electromagnet with the first polarity, wherein the second electromagnet produces an attractive force on the permanent magnet, the attractive and repellant forces cooperating to move the bolt to the second position.

12. The electro-magnetically operated bolt system of claim 1, wherein the bolt is a reciprocating bolt.

13. A pneumatic projectile launcher comprising: a receiver body; a breech within the receiver body, the breech terminating in a firing chamber; a movable bolt located in the breech; a control assembly capable of controlling a loading operation, the control assembly comprising at least one electromagnet that selectively moves the bolt via magnetic force acting on the bolt between an open position wherein a projectile enters the breech and a closed position wherein the projectile is loaded into the firing chamber to complete the loading operation.

14. The pneumatic projectile launcher of claim 13, wherein the bolt is a reciprocating bolt.

15. The pneumatic projectile launcher of claim 13, the control assembly further comprises at least one magnetic portion disposed proximal to the at least one electromagnet; and a control device for selectively energizing the electromagnet wherein the electromagnet generates a magnetic field that exerts a force on the at least one magnetic portion thereby selectively moving the bolt between the open and closed positions.

16. The pneumatic projectile launcher of claim 15, wherein the at least one electromagnet is disposed in the receiver body adjacent the breech and the at least one magnetic portion is disposed within the bolt.

17. The pneumatic projectile launcher of claim 15, wherein the at least one electromagnet is disposed in the bolt and the at least one magnetic portion is disposed within the receiver body adjacent the breech.

18. The pneumatic projectile launcher of claim 15, wherein the magnetic portion consists of a permanent magnet, the control device energizing the at least one electromagnet with a first polarity wherein the force on the permanent magnet is an attractive force that moves the bolt to the open position and the control device energizing the at least one electromagnet with a second polarity wherein the force on the permanent magnet is an repellant force that moves the bolt to the closed position.

19. The pneumatic projectile launcher of claim 13, wherein the at least one electromagnet comprises a first electromagnet; a second electromagnet positioned in spaced relation to the first electromagnet; the launcher further comprising at least one magnetic portion disposed proximal to the first and second electromagnets; and a control device for selectively energizing the first and second electromagnets wherein the electromagnets generate independent magnetic fields that each exert a magnetic force on the at least one magnetic portion thereby selectively moving the bolt between the open and closed positions.

20. The pneumatic projectile launcher of claim 19, wherein the first electromagnet is disposed in the receiver body adjacent a forward portion of the breech, the second electromagnet is disposed in the receiver body adjacent a rear portion of the breech and the at least one magnetic portion is disposed within the bolt.

21. The pneumatic projectile launcher of claim 20, wherein the magnetic portion consists of a ferrous metal, the control device energizing the first electromagnet wherein the first electromagnet exerts an attractive force on the ferrous metal that moves the bolt to the open position and the control device energizing the second electromagnet wherein the second electromagnet exerts an attractive force on the ferrous metal that moves the bolt to the closed position.

22. The pneumatic projectile launcher of claim 20, wherein the magnetic portion consists of a permanent magnet, the control device energizing the first electromagnet with a first polarity, wherein the first electromagnet produces an attractive force on the permanent magnet and the control device energizing the second electromagnet with a second polarity, wherein the second electromagnet produces a repellant force on the permanent magnet, the attractive and repellant forces cooperating to move the bolt to the open position, and the control device energizing the first electromagnet with the second polarity, wherein the first electromagnet produces a repellant force on the permanent magnet and the control device energizing the second electromagnet with the first polarity, wherein the second electromagnet produces an attractive force on the permanent magnet, the attractive and repellant forces cooperating to move the bolt to the closed position.

* * * * *